US005363769A

United States Patent [19]

Bellak et al.

[11] Patent Number: 5,363,769

[45] Date of Patent: Nov. 15, 1994

[54] PRACTICE ROUND HAVING A PROJECTILE AND AN ADAPTER WITH THE SAME CALIBER AS THE PROJECTOR AND AN APPROPRIATE PROPELLING CHARGE

[76] Inventors: Jerry K. Bellak, 180 Spring St., Johnstown, Pa. 15906; Joel B. Freidhoff, 150 Freidhoff La., Johnstown, Pa. 15902

[21] Appl. No.: 164,849

[22] Filed: Dec. 9, 1993

Related U.S. Application Data

[63] Continuation of Ser. No. 928,353, Aug. 12, 1992, abandoned, which is a continuation-in-part of Ser. No. 856,656, Mar. 24, 1992, abandoned.

[51] Int. Cl.[5] ..... F42B 8/00

[52] U.S. Cl. ..... 102/446; 42/77; 42/105; 102/501; 102/529

[58] Field of Search ..... 42/77, 1.08, 51, 105; 102/395, 444, 445, 446, 447, 498, 501, 502, 524, 529; 89/29

[56] References Cited

U.S. PATENT DOCUMENTS

| | | | |
|---|---|---|---|
| 40,958 | 12/1863 | Somes | 102/524 |
| 228,494 | 6/1880 | Valentine | 102/446 |
| 326,231 | 9/1885 | Manning | 102/501 |
| 1,517,702 | 12/1924 | Brubaker | 102/446 |
| 1,902,771 | 3/1933 | Gardos | 102/446 |
| 2,448,343 | 8/1948 | Zandmer | 102/524 |
| 2,786,415 | 3/1957 | Alderson . | |
| 3,156,995 | 11/1964 | Mellor et al. . | |
| 3,339,304 | 9/1967 | Knode, Jr. et al. . | |
| 3,640,013 | 2/1972 | Franklin . | |
| 4,126,954 | 11/1978 | Plummer . | |
| 4,232,468 | 11/1980 | Chapin | 42/77 |
| 4,361,093 | 11/1982 | Saxby . | |
| 4,553,479 | 11/1985 | Willoughby | 102/529 |
| 4,644,930 | 2/1987 | Mainhardt . | |
| 4,674,409 | 6/1987 | Lopata et al. | 102/471 |
| 4,682,545 | 7/1987 | Jett, Jr. . | |
| 4,702,170 | 10/1987 | Trudeau | 102/446 |
| 5,148,620 | 11/1990 | Nelson | 42/77 |

FOREIGN PATENT DOCUMENTS

| | | | |
|---|---|---|---|
| 378352 | 10/1907 | France | 42/77 |
| 15298 | of 1892 | United Kingdom | 102/444 |

*Primary Examiner*—Harold J. Tudor
*Attorney, Agent, or Firm*—Wegner, Cantor, Mueller & Player

[57] ABSTRACT

A practice tear gas round comprises a projectile having the same caliber as the standard tear gas gun, and a main adapter which is separately loadable into the launcher and has an outside diameter of the same caliber as the launcher while providing a chamber of reduced diameter for use of the launcher with devices of smaller caliber than the launcher. Preferably, an auxiliary adapter is receivable within the chamber of the main adapter in order to further reduce the caliber of propelling charge which is to be used for the practice round, while allowing removal of the auxiliary adaptor in order to receive in the main adaptor a standard 12 gauge shot shell, for example, for use of the launcher as a single shot 12 gauge shot gun. Additionally, the standard gas gun can be converted to a single shot rifle or shot gun for firing various other smaller calibers of cartridges and/or shot shells according to the auxiliary adaptor selected and inserted into the main adaptor for reception of a cartridge or shot shell. The projector also may be a cannon or a mortar, with the practice round sized accordingly. Further, the practice projectile may be connected to a main or auxiliary adapter separately from the projector.

15 Claims, 3 Drawing Sheets

PRACTICE ROUND HAVING A PROJECTILE AND AN ADAPTER WITH THE SAME CALIBER AS THE PROJECTOR AND AN APPROPRIATE PROPELLING CHARGE

This application is a continuation of U.S. application Ser. No. 07/928,353 filed Aug. 12, 1992, now abandoned, which is a continuation-in-part of U.S. application Ser. No. 07/856,656, filed Mar. 24, 1992, now abandoned.

PRIOR ART CROSS REFERENCES

U.S. Pat. No. 2,786,415 to ALDERSON, entitled MORTAR TRAINING DEVICE, granted Mar. 26, 1957.

U.S. Pat. No. 3,156,995 to MELLOR, et al., entitled SHOTGUN GAUGE ADAPTER, granted Nov. 17, 1964.

U.S. Pat. No. 3,339,304 to KNODE, Jr., et al., entitled SHOTGUN GAUGE ADAPTER, granted Sep. 5, 1967.

U.S. Pat. No. 3,640,013 to FRANKLIN, entitled SUBCALIBER ADAPTER FOR FIREARM, granted Feb. 8, 1972.

U.S. Pat. No. 4,126,954 to PLUMMER, entitled GUN SHELL CONVERTER, granted Nov. 28, 1978.

U.S. Pat. No. 4,361,093 to SAXBY, entitled AMMUNITION FOR SMALL ARMS, granted Nov. 30, 1982.

U.S. Pat. No. 4,644,930 to MAINHARDT, entitled GUN FOR FIRING A VARIETY OF PROJECTILES, granted Feb. 24, 1987

U.S. Pat. No. 4,682,545 to JETT, Jr , entitled AMMUNITION ROUND, granted Jul. 28, 1987.

BACKGROUND OF THE INVENTION

Generally, the invention deals with tear gas launcher capabilities and, more particularly, is directed to providing a system by which standardly available blank cartridges, for instance .38 Special and .38 S&W blanks, are used as the charge for propelling a practice projectile from the standard police tear gas launcher. The system also provides for converting the tear gas launcher to a single shot rifle or shot gun in emergency situations.

A major problem that exists in firearm certification for officers of the law is certification in the use of a tear gas gun or launcher, with a particular problem of training for the certification being rooted in the complexity and cost of hand-loading the practice rounds presently used in such training.

The practice rounds presently used for training in the use of the standard 37/38 mm (1.5 inch) tear gas gun consist of a charged casing and attached projectile, both with outside diameters of 37 millimeters or so for reception with the chamber of the launcher.

Reloading these prior art practice rounds involves: locating and retrieving the projectile from down range; removing the primer cap from the spent casing; seating a new primer firmly in the casing; dumping a powder charge into the open of the casing; inserting a cardboard disc into the casing to retain the powder charge in the bottom of the casing; inserting the paper or cloth wad to prevent powder from coming up through the hole in the disc; inserting the felt; and inserting and driving the end of the projectile into the casing while taking care not to activate the primer.

Clearly, reloading of these practice rounds is a time consuming procedure which requires extensive training and consumes a great deal of time, while presenting complexities for safe handling of the charges. Further, the charged and assembled practice round does not lend itself to changing the charge so as to change the projection range.

Additionally, the smoke which emanates from the barrel of the tear gas launcher, when a prior art practice round is fired, obstructs the view of the user sufficiently to make subsequent location and retrieval of the practice projectile more difficult and time consuming than is desirous. Thus, there is a need for reducing the powder charge and consequent smoke of the practice round.

Thus, it is an object of the invention to provide a considerably improved practice round, at least from the viewpoint of: reduced cost, simplified and safer procedure for reloading, and readily interchangeable propelling charges for attaining different projection distances.

Further, it is an object of the invention to provide a practice projectile which has a much reduced charge and closely matches the speed and distance of a live tear gas round, while having the same caliber of, and using the aiming and guidance of, the launcher.

Also, it is an object of the invention to provide a propelling charge for the inventive practice round which is small enough that smoke from the barrel of the launcher does not hinder the ability of the user to locate the projectile that is fired.

Still further, it is an object of the invention to provide for use of the standard launcher as a single shot rifle or shot gun, thus expanding the options available to the law officer in emergency situations.

Additionally, it is the object of one embodiment of the invention to provide a projectile which is snugly receivable within the bore of an adapter so as to establish a connection therebetween independently of the barrel of the projector.

It is also an object of the invention to provide practice rounds for larger caliber devices such as launchers, 105 millimeter cannons, and the like in which the projectiles may be associated with one or more adaptors for receiving various different charges of reduced size which are capable of projecting the practice projectile for distances which are commensurate with the live rounds that they are simulating.

These and other objects of the invention will become more apparent from the remainder of the disclosure herein.

SUMMARY OF THE INVENTION

A practice tear gas round comprises a projectile having the same caliber as the standard tear gas gun, and a main adapter which is separately loadable into the launcher and has an outside diameter of the same caliber as the launcher while providing a chamber of reduced diameter for use of the launcher with devices of smaller caliber than the launcher. Preferably, an auxiliary adapter is receivable within the chamber of the main adapter in order to further reduce the caliber of propelling charge which is to used for the practice round, while allowing removal of the auxiliary adapter in order to receive in the main adapter a standard 12 gauge shot shell, for example, for use of the launcher as a single shot 12 gauge shot gun. Additionally, the standard gas gun can be converted to a single shot rifle or shot gun for firing various other smaller calibers of cartridges and/or shot shells according to the auxiliary adapter selected and inserted into the main adaptor for reception of a cartridge or shot shell.

In one embodiment of the invention, the projectile has a tail portion which is considerably smaller than the caliber of the projectile and is snugly and slidably receivable within a nose bore of the adapter for connection thereto separately from the barrel of the projector. With this structure, the practice round can be assembled outside of the projector.

DETAILED DESCRIPTION OF THE INVENTION

Figure 1:
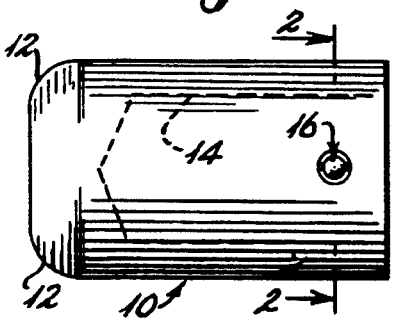
FIG. 1 is a side elevational view of the practice projectile of the invention.
Figure 2:
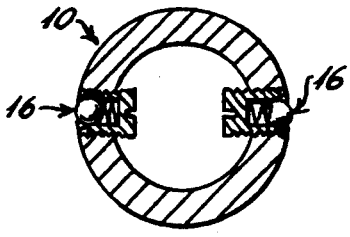
FIG. 2 is a cross-section as viewed generally in the direction of arrows 2—2 in FIG. 1.
Figure 3:
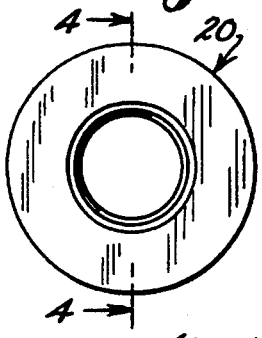
FIG. 3 is a rear end view of the main adaptor of the invention.
Figure 4:
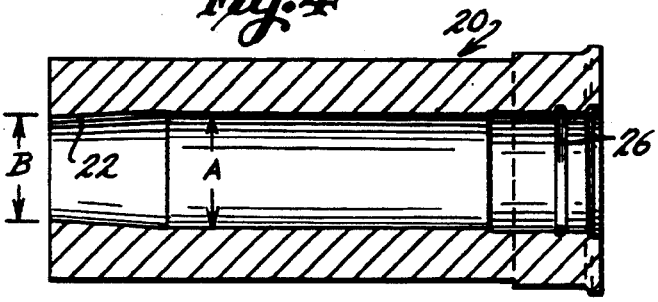
FIG. 4 is a cross-section as viewed generally in the direction of arrows 4—4 in FIG. 3.
Figure 5:
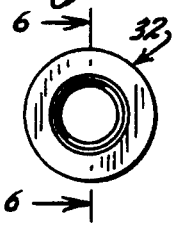
FIG. 5 is a rear end view of an auxiliary adaptor which further reduces the caliber of propelling charge used for the practice projectile, as well as the shot shell which may be fired from the standard tear gas gun.
Figure 7:
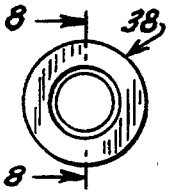
FIG. 7 is a rear end view of an auxiliary adaptor similar to that of FIG. 5, but for use with a different caliber propelling charge and, alternatively, with a rifle shell of corresponding caliber.

In order to provide simplicity of loading, cleaning, and training in safe use of the invention, it was decided to create a system that would use the standard police tear gas projector, including the existing sights, bore for guiding the projectile, firing pin, and triggering device existing in the projector. In order to eliminate the need for the user to reload the practice projectile into the casing, as in the prior art, a practice projectile 10 (FIGS. 1 and 2) is used with, but as a separate entity from, main adapter 20 (FIGS. 3 and 4). Main adaptor 20 provides that a propelling charge of caliber smaller than the caliber of the tear gas projector 2 may be used to propel the practice projectile 10, of the same caliber as the tear gas projector 2, from the projector with a projection performance substantially the same as that of a live tear gas round.

Figure 6:
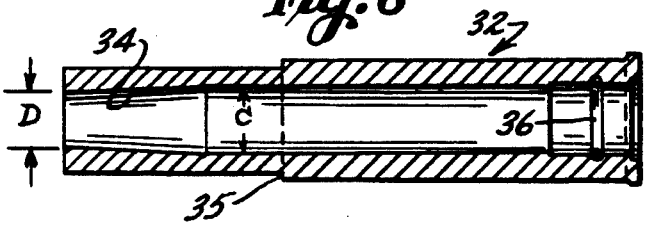
FIG. 6 is a cross-section as viewed generally in the direction of the arrows 6—6 in FIG. 5.
Figure 9:
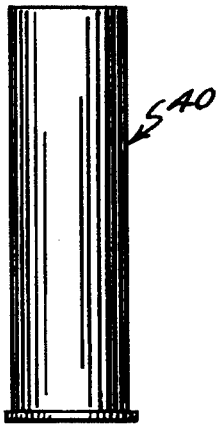
FIGS. 9–12 are plan views, respectively, of a 12 gauge shot shell, a 410 gauge shot shell, a .44 caliber blank, and a .44 caliber cartridge.
Figure 10:
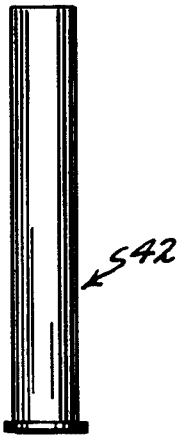

Main adapter 20 seats in the chamber of the launcher 2 to provide a chamber of reduced diameter for use of the launcher 2 with devices of smaller caliber than the launcher 2, such devices being a shot shell, for example the 12-gauge shotgun shell 40 of FIG. 9, or any of a set of auxiliary adapters for further reducing the caliber required for use with the launcher. For instance, the auxiliary adapter 32 of FIG. 6 is adapted to seat within the 12-gauge bore of main adapter 20 and provide a further reduced caliber bore for reception of a 410-gauge shotgun shell 42 illustrated in FIG. 10.

Figure 8:
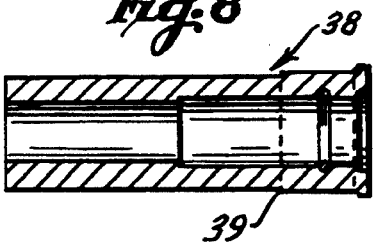
FIG. 8 is a cross-section as viewed generally in the direction of the arrows 8—8 in FIG. 7.
Figure 11:
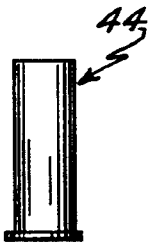
Figure 12:
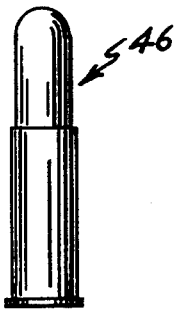

The auxiliary adapter 38 of FIG. 8 is also seatable within main adapter 20 and is provided with an internal bore into which a .44 caliber blank cartridge 44 (FIG. 11) or a .44 caliber live cartridge 46 (FIG. 12) is seatable. When using a live shot shell or live cartridge, the invention allows the tear gas projector to double as a single-shot emergency weapon. Otherwise, the invention provides for practice and training for certification in use of the standard teargas projector, while utilizing readily available standard blank cartridges such as the .44 caliber, .38 special, and .38 S & W blank cartridges as propellants.

Referring to FIG. 4, the internal bore of the main adapter 20 is tapered at 22 so as to alter the projection pattern of shot of a 12-gauge shell as it exits the main adapter 20. Without the tapering 22, it was found that the shot pattern would expand too rapidly and strike and damage the inner surface of the barrel of the teargas projector during discharge. By providing the tapered inner surface (choke) 22, the pattern was altered sufficiently to prevent the shot from striking the internal surface of the barrel. As seen in FIG. 6, similar tapering 34 is provided in the .410-gauge auxiliary adapter 32. The reason for adapting the teargas projector to fire two different sizes of shotgun shells is that there are different qualities of teargas guns, and it was found that cheaper, single-locking guns became slightly damaged after several 12-gauge shots. Although this damage was easily repaired, it is suggested that live shotgun shells only be used in double locking guns.

Figure 13:
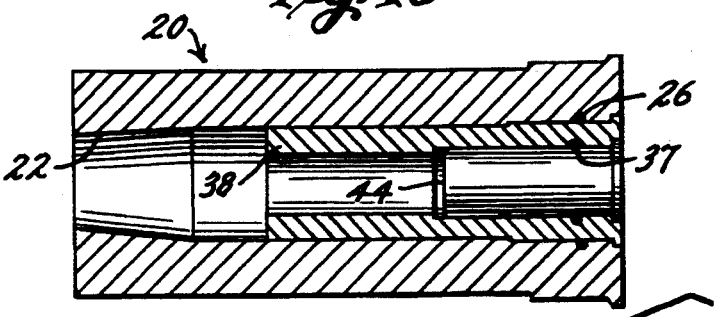
FIG. 13 is cross-sectional view illustrating seating of one of the auxiliary adapters in the main adaptor and, in turn, seating of a blank cartridge in the auxiliary adaptor.

FIG. 13 illustrates main adapter 20 with the .44 caliber auxiliary adapter 38 seated therein and a .44 caliber blank seated within the auxiliary adapter 38, to provide the charge used for propelling practice projectile 10.

Figure 14:
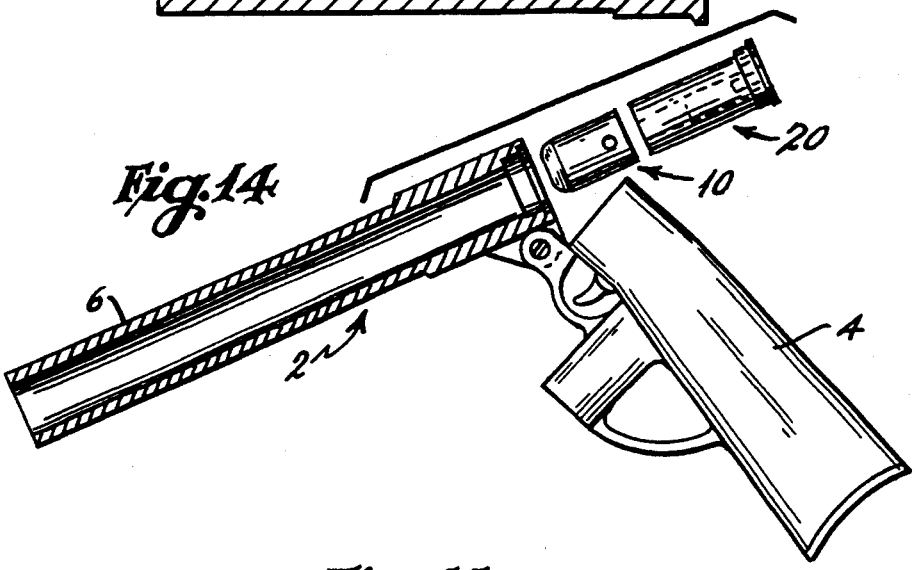
FIG. 14 is an elevational view, partially in section, of a standard tear gas gun and illustrates loading of the composite charge casing of FIG. 13, as a separate entity from the practice projectile of FIGS. 1 and 2, into the standard tear gas gun.

FIG. 14 illustrates loading of the standard launcher 2 with insertion of practice projectile 10 into the barrel 6 of the launcher prior to insertion of the charge (of FIG. 13) therein. In order to prevent the practice projectile 10 from freely sliding out of the barrel 6, a pair of oppositely disposed threaded inserts with spring loaded balls 16 are installed in the practice projectile 10 so as to provide a balanced, frictional force by which the projectile 10 is retained within the barrel 10 in preparation for firing of the teargas gun 2.

Figure 15:
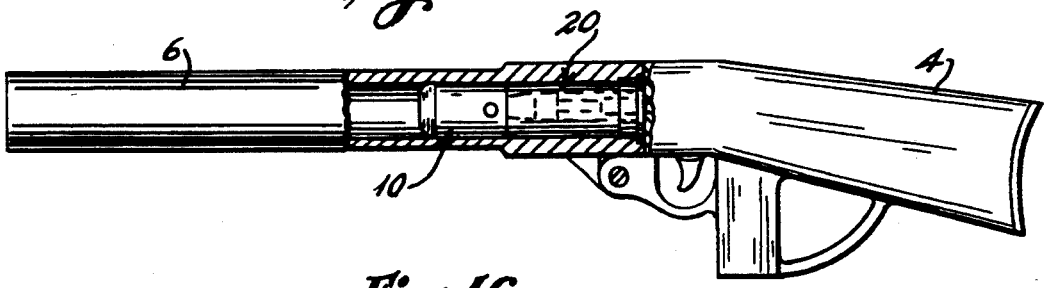
FIG. 15 is an elevational view, partially in section, of the tear gas gun of FIG. 14 after being locked and loaded.

FIG. 15 illustrates the teargas projector locked and loaded for firing of a practice projectile 10.

Figure 16:
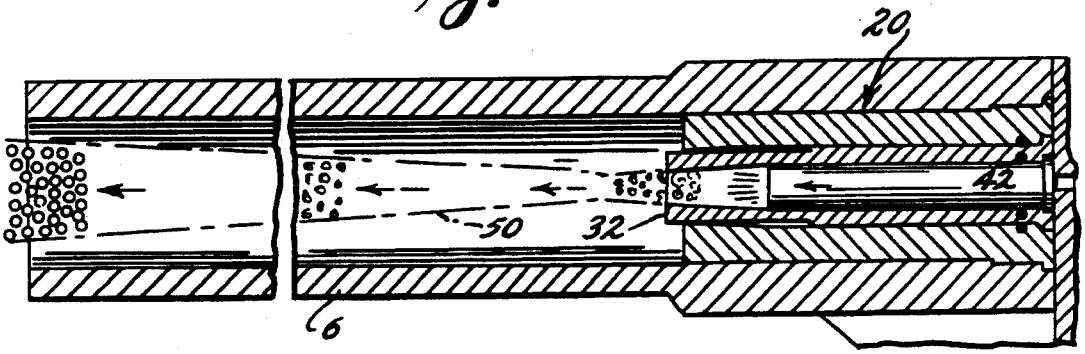
FIG. 16 is a partial, sectional view illustrating use of the tear gas projector as a single-shot gun firing a 410 gauge shot shell.
Figure 20:
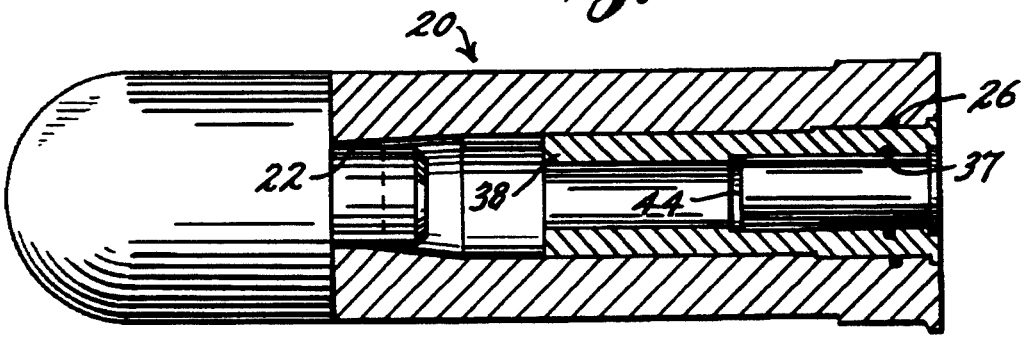
FIG. 20 is a partial cross-section illustrating a fully assembled practice round having a main adapter which receives the reduced tail portion of the practice projectile in one end and a smaller auxiliary adapter in the other end, with the auxiliary adapter receiving a still smaller charge for propelling the practice projectile.

FIG. 16 illustrates the use of the 410-gauge auxiliary adapter for firing of a 410-gauge shot shell 42. This Figure illustrates alteration (i.e., reduction in cross section) of the shot pattern 50 by the tapered inner surface 34 of the auxiliary adapter 32 in order to prevent damage to the inner surface of barrel 6. This Figure also clearly discloses the need for reducing the outer diameter of this particular auxiliary adapter in order that it will project from the reduced diameter at the end of main adapter 20, this reduced diameter being due to the tapering 22 of main adapter 20. As illustrated in FIGS. 4 and 6, the inner diameters of main adaptor 20 and auxiliary adaptor 32 have respective o-rings 26 and 36 which also are depicted in FIG. 16. FIGS. 13 and 20, similar to FIG. 16, each depict the o-ring 37 of auxiliary adaptor 38 (of FIG. 8).

In developing prototypes of the apparatus of the invention, the 12-gauge caliber was selected for the internal bore of main adapter 20 in order to provide for firing of a standard 12-gauge shot shell while providing a size sufficient to further adapt down to a wide variety of blank and live charges.

Rubber balls were fired from the device in order to approximate the propelling range of each standard blank and, thereafter, tests were conducted using projectiles made from aluminum. Use of aluminum reduced the weight of the projectile so that a smaller charge would project the projectile at the same speed and distance as that of a heavier projectile propelled by a greater charge. After test firing a number of lengths, configurations, and diameters of test projectiles, it was found that a radius on the front end of the projectile and a bore in the rear thereof, which was approximately two-thirds of the outside diameter of the projectile, served to stabilize the projectile's flight. It was also found that a clearance between the barrel and projectile of 0.040" made the projectile unstable and inaccurate, while shooting of projectiles with minimum barrel clearance caused excessive pressure build-up which the gun was not intended to withstand. Accordingly, proper projectile clearance is mandatory, and the clearance selected for this application is 0.030".

The main adapter 20 is made from stainless steel for strength and ease of cleaning.

12-gauge, .44 magnum, .38 special, 32 caliber, 243 caliber, and .38 S & W blanks were test fired in order to arrive at the best combination of blank and auxiliary adapter for use in propelling the practice projectiles. After live firing of teargas to determine the exact distance, the practice projectile sizes were tuned to approximately 2.5" in length, 1.5 inch in diameter with a ⅜ inch radius at the front surface thereof and a 1 inch hole, 2 inches deep bored in the rear surface thereof. With these specifications, the .38 special blank is used to simulate a 150 yard shot and the .38 S & W blank is used to simulate the 75 yard shot. It was found that the 243 and 32 caliber blanks did not contain enough charge to use in any simulation and that the 12-gauge blanks would overproject any size or shaped projectile. A variety of charges and shells have been tested, as well as adapters for use with various pistol calibers for use of the teargas projector as a single-shot weapon.

Figure 17:
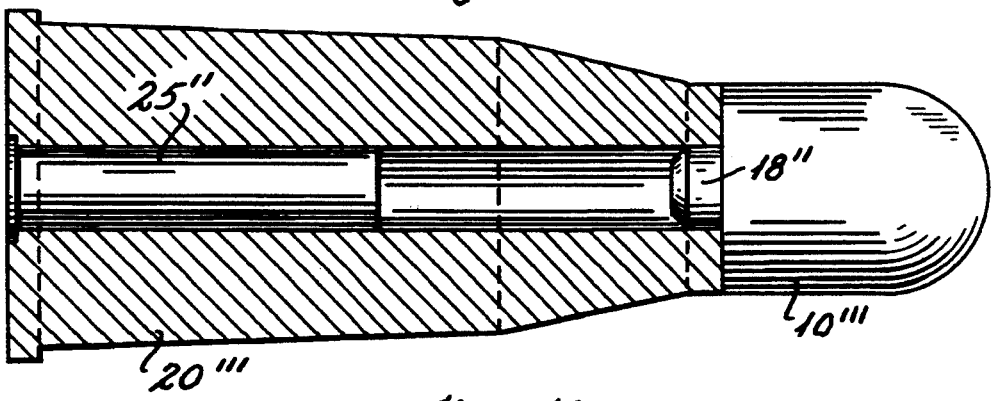
FIG. 17 is a partially cross-sectional view longitudinally of a fully assembled practice round for 105 mm cannon of an M60 tank.
Figure 18:
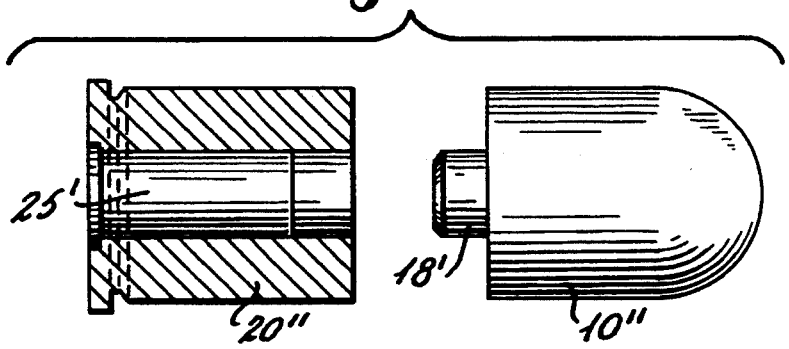
FIG. 18 illustrates a practice round for a 40 mm launchers tube with the blank cartridge situated in the main adapter and the projectile properly positioned for insertion into the adapter.
Figure 19:
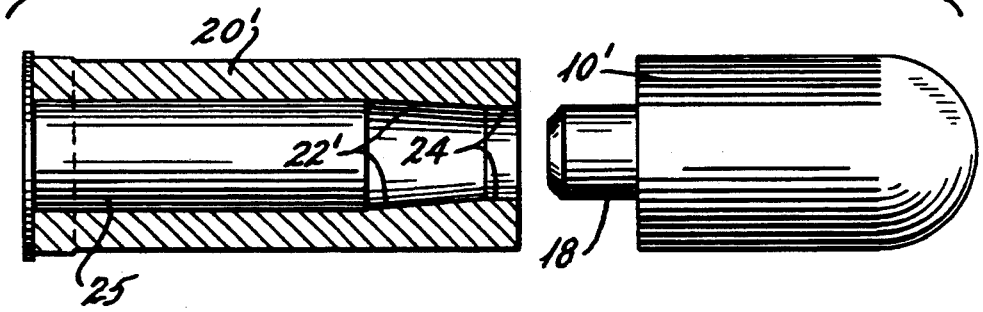
FIG. 19 illustrates a practice round for a tear gas launcher in which the main adapter is a modification of the main adapter FIG. 4 and the blank cartridge and projectile are insertable into the main adapter, or a comparably modified auxiliary adapter, in order to complete assembly of the round.

FIGS. 17–19 illustrate embodiments of the invention in which the practice round may be fully assembled in preparation for loading into the projector by providing practice projectiles fit slidably and snugly into the front end of the adapter.

In FIG. 17, an assembled practice round includes a practice projectile 10''' of the same caliber as the bore of a 105 mm cannon and having a tail portion 1841 inserted into the adapter 20''' which is sized for reception into the chamber of the cannon. An appropriate charge 25' is used as the propellant.

The 40 mm mortar practice round of FIG. 18 has the appropriate main adapter 20'', blank charge 25', and practice projectile 10''.

FIG. 19 illustrates a modification of the earlier described practice round for a teargas launcher. The main adapter 20' is a modified version of adapter 20 of FIG. 4 in that a short nose bore 24 of constant diameter intersects the tapered I.D. of the adapter so as to act as a guide during insertion of the tail portion 18 of practice projectile 10' into the front end of adapter 20'. A bevel is provided on the end of tail portion 18 for ease of insertion of the projectile into the adapter. In FIG. 20, a fully assembled practice round incorporates a practice projectile having a caliber matching the bore of the projector and a reduced tail portion which fits slidingly and directly in the bore of the main adapter 20. Auxiliary adapter 38, similarly received in the other end of main adapter 20, presents a still smaller bore for receiving charge 44.

Although the embodiments of FIGS. 17–20 lend themselves to full assembly of the practice round prior to insertion into the projector, it is contemplated that the rounds of FIGS. 17 and 19 may be assembled piecemeal in the projector as in FIG. 14. It also is possible to load the round, minus the propellant, into the projector for subsequent charging of the round as desired.

Thus, the objects set forth above, among those made apparent from the preceding description, are efficiently attained and, since certain changes may be made in the construction set forth without departing from the scope of the invention, it is intended that all matter contained in the above description or shown in the accompanying drawings shall be interpreted as illustrative and not in a limiting sense. For instance, it is also contemplated that the practice projectile, which is retrievable for reuse, may be made from plastic or the like rather than aluminum.

The following claims are intended to cover all of the generic and specific features of the invention herein described and all statements of the scope of the invention which, as a matter of language, might be said to fall therebetween.

Now that the invention has been described, we claim:

1. A kit selectively configurable for adapting a projector bore of a particular caliber to receive various selectable rounds for discharge by said projector, said rounds comprising live rounds comprising live cartridges and live shot shells and practice rounds utilizing blank cartridges as propellants, a first set of elements being said live rounds and said blank cartridges having a first caliber which is reduced relative to said particular caliber, and a second set of elements being other of said live rounds and said blank cartridges which are further reduced in caliber relative to said first caliber, said kit comprising:

a main adaptor removably seatable within said projector bore and having an outer diameter of said particular caliber and a bore of said first caliber into which elements of said first set are selectively, individually and removably seatable for discharge by said projector;

an auxiliary adaptor selectively, individually and removably seatable within said main adaptor bore and having an outer diameter of said first caliber and a bore smaller than said first caliber and equal in caliber to at least one of said elements of said second set such that at least one element of said second set is selectively, individually and removably seatable within said auxiliary adaptor bore for discharge;

at least one practice projectile, useable as part of each of said practice rounds only, being situated within said projector bore and at a front end of at least said main adapter just prior to said discharge;

said kit being configurable so that said main adaptor is useable without and with said auxiliary adaptor, selectively and respectively, according to which of said first and second sets of rounds is selected for discharge by said projector, and so that said practice projectile is useable only when said blank cartridges are selected for discharge by the projector.

2. A kit as in claim 1, and further comprising:

a gradual reduction in diameter of said bore of at least one of said main and auxiliary adaptors, with said reduction being sufficient to alter a shot projection pattern in order to prevent damage to said projector bore when said projector is used as a single-shot shotgun.

3. A kit as in claim 2, wherein said gradual reduction comprises:

a generally conical tapering of said bore.

4. A kit as in claim 1, wherein said practice projectile comprises:

a body; and friction means for engaging said bore of said projector in order to retain said practice projectile in said projector bore in preparation for firing of said projector.

5. A kit as in claim 4, wherein said friction means comprises:

at least one bearing member attached to said body and means for spring biasing said bearing member into engagement with, and generally laterally to a longitudinal axis of, said projector bore.

6. A kit as in claim 4, wherein said practice projectile further comprises:

said body being made of aluminum and having a generally hollow base portion, opening toward a charge of said practice round, and a generally rounded head portion.

7. A kit as in claim 1, and further comprising:

at least one other auxiliary adaptor having an outer diameter equal to said first caliber and a bore which is less than said first caliber, differs in caliber from said bore of said auxiliary adaptor, and is equal in caliber to at least one other element of said second set such that at least one other element of said second set is selectively, individually, and removably seatable within said bore of said at least one other auxiliary adaptor for said discharge.

8. A kit as in claim 1, and further comprising:

said practice projectile being of said particular caliber.

9. A kit as in claim 1, and further comprising:

each said practice round including said practice projectile and a remaining portion to which said practice projectile is not attached, such that said practice projectile is loadable into said projector bore separately from said remaining portion of each of said practice round.

10. A kit as in claim 1, and further comprising:

each said practice round including said practice projectile and a remaining portion to which said practice projectile is attachable for loading said round into said projector while said practice projectile and said remaining portion are attached together.

11. A kit as in claim 1, and further comprising:

said practice projectile being reusable.

12. A kit as in claim 1, said practice projectile further comprising:

a tail portion having an outer diameter equal to and snugly slidable and receivable within said main adaptor bore and substantially smaller than a caliber of said practice projectile.

13. A kit as in claim 1, wherein said bores of said main and auxiliary adaptors each having a front portion and a rear portion, and further comprising:

said front portion of at least one of said adaptors having a sufficient amount of generally uniform diameter for stable reception of a tail portion of said practice projectile.

14. A kit selectively configurable for adapting a projector having a bore of a particular caliber to fire various live rounds of reduced caliber and live rounds further reduced in caliber from said projector, selectively, said live rounds comprising live cartridges and live shot shells, and said kit comprising:

a main adaptor removably seatable within said projector bore and having an outer diameter of said particular caliber and a bore of said reduced caliber;

a set of auxiliary adaptors being removably seatable within said main adaptor bore, each of said auxiliary adaptors having an outer diameter of said reduced caliber and a bore, and each said auxiliary adaptor bore being further reduced in caliber and different in caliber from each other auxiliary adaptor bore;

whereby said live rounds of reduced caliber are selectively receivable in said projector for firing therefrom by being individually and interchangeably seatable in said main adaptor which is seated in said bore of said projector; and said live rounds further reduced in caliber are selectively receivable in said projector for firing therefrom by each being individually and interchangeably seatable in an auxiliary adaptor corresponding to and having a bore equal in caliber thereto, each said auxiliary adaptor being seatable in said main adaptor which, in turn, is seatable in said bore of said projector.

15. A kit selectively configurable for adapting a projector having a bore of a particular caliber to fire practice rounds and for adapting blank cartridges of reduced caliber and blank cartridges further reduced in caliber for selective and individual use as a propellant for each practice round, and said kit comprising:

a practice projectile;

a main adaptor having an outer diameter of said particular caliber and a bore of said reduced caliber, said main adaptor being removably seatable within said projector bore;

a set of auxiliary adaptors being removably seatable within said main adaptor bore, each of said auxiliary adaptors having an outer diameter of said reduced caliber and a bore, and each said auxiliary adaptor bore being further reduced in caliber and different in caliber from each other auxiliary adaptor bore;

whereby said practice projectile is receivable in said projector and said blank cartridges of reduced caliber are selectively receivable in said projector as a propellant for firing said practice projectile therefrom by being individually and interchangeably seatable in said main adaptor which is seated in said bore of said projector; and whereby said blank cartridges further reduced in caliber are selectively receivable in said projector for firing said practice projectile therefrom by being individually and interchangeably seatable in a selected auxiliary adaptor having a bore equal in caliber to a selected one of said blank cartridges further reduced in caliber, said auxiliary adaptor being seatable in said main adaptor which, in turn, is seatable in said bore of said projector.

* * * * *